US008109015B2

(12) United States Patent
Signori

(10) Patent No.: US 8,109,015 B2
(45) Date of Patent: Feb. 7, 2012

(54) SPORTS SHOE PARTICULARLY FOR CYCLING

(75) Inventor: Dino Signori, Maser (IT)

(73) Assignee: Sidi Sport S.r.l., Maser (IT)

( * ) Notice: Subject to any disclaimer, the term of this patent is extended or adjusted under 35 U.S.C. 154(b) by 644 days.

(21) Appl. No.: 12/296,508

(22) PCT Filed: Nov. 10, 2006

(86) PCT No.: PCT/EP2006/010799

§ 371 (c)(1),
(2), (4) Date: Nov. 12, 2008

(87) PCT Pub. No.: WO2007/112774

PCT Pub. Date: Oct. 11, 2007

(65) Prior Publication Data

US 2009/0133293 A1 May 28, 2009

(30) Foreign Application Priority Data

Apr. 3, 2006 (IT) ..... PD2006A0118

(51) Int. Cl.
*A43B 5/00* (2006.01)
*A43B 23/28* (2006.01)

(52) U.S. Cl. ..... 36/131; 36/25.8; 36/69

(58) Field of Classification Search ..... 36/131, 36/58.6, 58.5, 69, 80, 92, 117.6, 117.8
See application file for complete search history.

(56) References Cited

U.S. PATENT DOCUMENTS

| | | | | |
|---|---|---|---|---|
| 907,703 | A * | 12/1908 | Peterson | 36/58.5 |
| 4,922,634 | A * | 5/1990 | Seidel | 36/117.8 |
| 4,972,613 | A | 11/1990 | Loveder | |
| 5,020,248 | A * | 6/1991 | Hercog et al. | 36/117.8 |
| 5,463,822 | A | 11/1995 | Miller | |
| 6,289,558 | B1 | 9/2001 | Hammerslag | |
| 6,298,582 | B1 * | 10/2001 | Friton et al. | 36/88 |
| 7,225,563 | B2 * | 6/2007 | Chen et al. | 36/58.5 |
| 2003/0079376 | A1 | 5/2003 | Oorei et al. | |

FOREIGN PATENT DOCUMENTS

| | | | |
|---|---|---|---|
| DE | 9307480 | U1 | 10/1994 |
| WO | 9325107 | A | 12/1993 |

* cited by examiner

*Primary Examiner* — Marie Patterson
(74) *Attorney, Agent, or Firm* — Volpe and Koenig, P.C.

(57) ABSTRACT

A sports shoe, particularly for cycling, comprising a sole and a vamp in which is identified a heel area having a rear part from which extend respective walls juxtaposed and spaced for bilaterally encircling the heel of the user; in the heel area it comprises a pair of presser arms extending like a pincer, each behind the corresponding vamp wall at an upper part thereof, distal with respect to the sole, and located normally above the heel of the user.

15 Claims, 2 Drawing Sheets

Fig. 2B
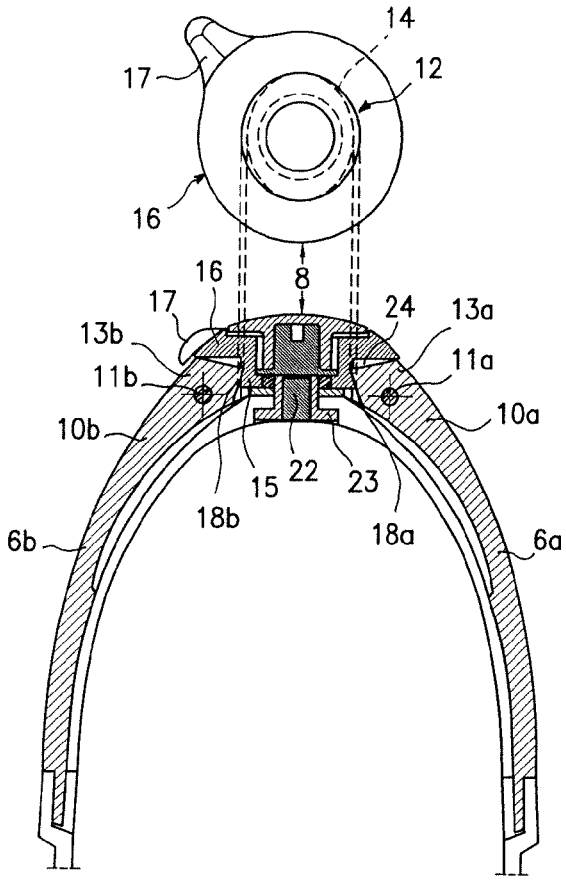
Fig. 2A
Fig. 3B
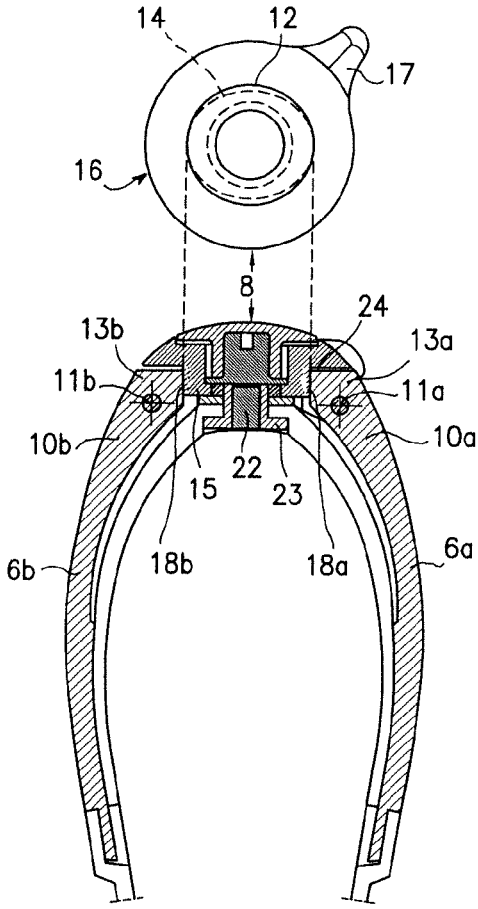
Fig. 3A

SPORTS SHOE PARTICULARLY FOR CYCLING

TECHNICAL FIELD

The subject of the invention is a sports shoe particularly for cycling, of the type including the characteristics mentioned in the preamble of the main claim.

PRIOR ART

In the cycling field it is known to produce footwear provided with various clamping devices suitable for dealing with different stresses in order to obtain improved locking of the foot in the shoe.

Typically, these devices are concentrated on the instep area of the shoe, providing for adjustable clamping of the band of vamp which surrounds the instep.

The clamping of the instep area is reflected only partially on the heel area, leaving the latter relatively free to move in the shoe.

This drawback is increased in the case of slim feet, since the clamping on one area, for example the instep area, has a lesser influence on the other areas of the shoe.

However, in the cycling field there is a need for effective locking of the foot, in particular when pedalling is performed both by pressure on the pedal and by pulling upwards.

DESCRIPTION OF THE INVENTION

The problem underlying the present invention is that of providing a sports shoe, particularly for cycling, which is structurally and functionally designed so as to make it possible to remedy all the drawbacks mentioned with reference to the prior art cited.

Within the scope of this problem, it is an important aim of the invention to produce a sports shoe capable of adapting to feet of completely different shape.

This problem and this aim are solved by the invention with a sports shoe particularly for cycling having the characteristics mentioned in the following claims.

BRIEF DESCRIPTION OF THE DRAWINGS

The characteristics and advantages of the invention will become clearer from the detailed description of a preferred, but not exclusive, exemplary embodiment thereof, illustrated by way of non-limiting example, with reference to the appended drawings, in which:

FIGS. 2A, 2B and 3A, 3B are views respectively in longitudinal section and in elevation of a detail of the shoe of FIG. 1 in two operating positions;

PREFERRED EXAMPLE OF THE INVENTION

Figure 4:
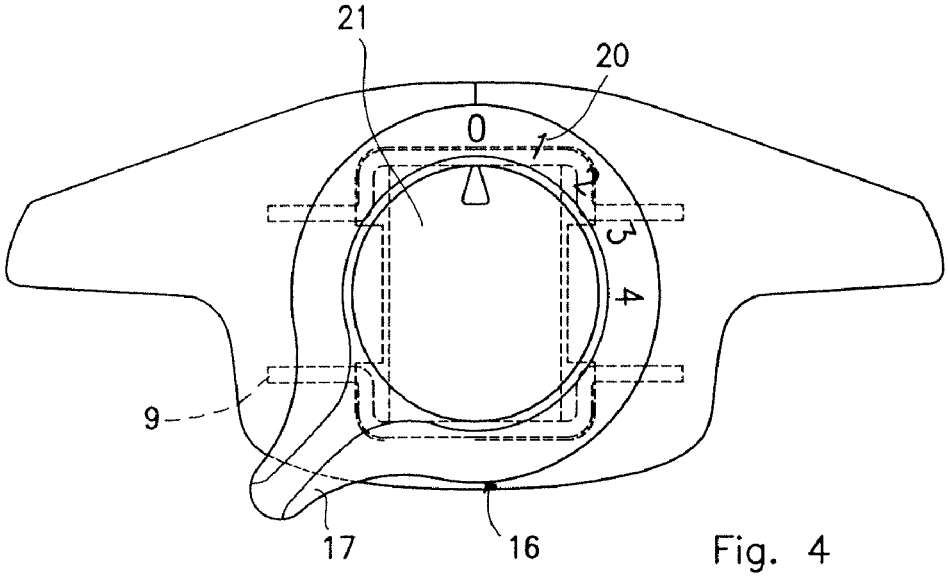
FIG. 4 is a diagrammatic view in elevation of a detail of the shoe of FIG. 1.
Figure 1:
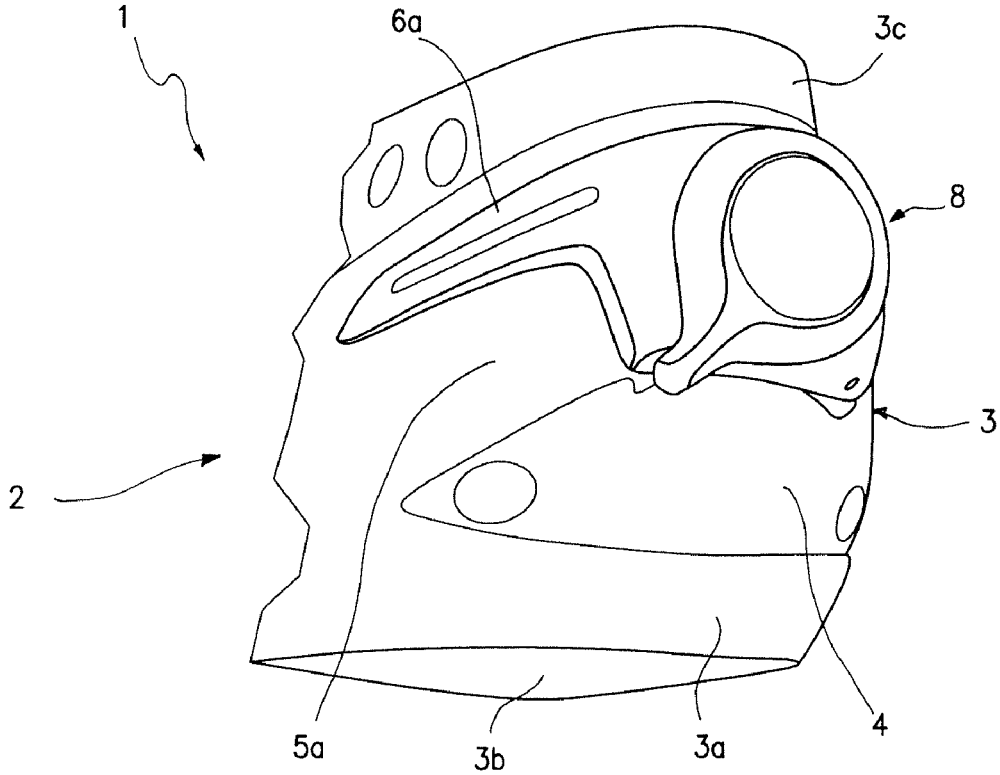
FIG. 1 is a partial perspective view from the rear side of a sports shoe particularly for cycling, according to the present invention.

In FIG. 1, the reference 1 indicates as a whole a sports shoe particularly for cycling, produced according to the present invention.

The sports shoe 1 comprises a vamp 2, in which a heel area 3 is identified, having a lower part 3*a* proximal to a sole 3*b*, and an upper part 3*c* distal with respect to the sole and located normally above the heel of the user.

The heel area 3 comprises a rear part 4 from which extend respective walls 5*a*, 5*b* juxtaposed and spaced for bilaterally encircling the heel of the user.

A pair of presser arms 6*a*, 6*b* extends like a pincer in the heel area 3 at the upper part 3*a*, and each of the presser arms 6*a*, 6*b* extends behind the corresponding wall 5*a*, 5*b* of the vamp 2 above (or distally with respect to the sole) the heel of the user. The arms may be fixed, in a fork-like configuration in which they are capable of being moved apart only through a limited resilient effect, or capable of being pivoted with respect to one another.

In the second case, actuating means 8 act between the presser arms 6*a*, 6*b* to displace them between a position for clamping of the heel area 3 and a position for release of same.

The presser arms 6*a*, 6*b* extend in the same direction from a support 9 integral with the rear part 4 of the shoe. In the pivotal version, they have respective ends 10*a*, 10*b* rotatable on the support 9 by means of corresponding pins 11*a*, 11*b*.

The arms 6*a*, 6*b* are hinged to the support 9 in a position such that, for each of the arms, a control appendage 13*a*, 13*b* is defined, extending on the opposite side with respect to the arms themselves, with reference to the hinge axis.

The actuating means 8 are adjustable into at least one intermediate position between the clamping position and the release position.

According to a preferred exemplary embodiment, the actuating means 8 are adjustable into three intermediate positions between the clamping position and the release position, and the displacement of the presser arms 6*a*, 6*b* is actuated by the actuating means 8 by means of a cam 12 rotatably supported on the support 9.

The cam 12 is bilateral with symmetrical cam profiles 14 of elliptical section.

The cam 12 is mounted on the support 9 between the control appendages 13*a*, 13*b* and is provided on a neck 15 integral with a control knob 16.

The control knob 16 is rotatably supported by a shaft 22 with a base 23 and rotations of the control knob 16 are actuated by means of a handgrip 17 thereof.

Advantageously, the cam 12 is provided in a hollow seat 24 suitable for housing the control appendages 13*a*, 13*b* of the presser arms 6*a*, 6*b*.

In the seat 24, cam-follower surfaces 18*a*, 18*b* of the control appendages 13*a*, 13*b* abut against the cam 12 in a manner dependent on the rotation of the control knob 16 with respect to the axis of the shaft 22.

The abutment occurs at the minor axis of the profiles 14 in the release position and at the major axis of same in the clamping position.

The intermediate positions correspond to intermediate angles of rotation of the control knob 16 between the clamping position and the release position, as indicated by marks 20 present on a plug 21 for fixing the control knob 16 to the shaft 22.

The functioning of the invention is described below.

The control knob 16 is rotated by means of the hand grip 17 until the angular displacement corresponding to the desired position of the presser arms 6*a*, 6*b* is reached.

The rotation of the control knob 16 involves an alteration in the state of abutment of the cam 12 with the cam-follower surfaces 18*a*, 18*b* and a consequent displacement of the control appendages 13*a*, 13*b* with respect to the hinge axis.

As a consequence, the pressure exerted by the presser arms 6*a*, 6*b* in the heel area 3 varies.

In the case of a fork with fixed arms, when the foot is inserted into the shoe, the heel portion is received between same arms with consequent retention of the rear part of the foot with respect to the vamp.

The invention thus solves the problem posed and obtains numerous advantages with respect to the prior art.

In particular, it permits easy adaptation, on the part of the user, of the same shoe to feet of completely different shape.

The invention claimed is:

1. A sports shoe, comprising a sole and a vamp in which is identified a heel area having a rear part from which extend respective walls juxtaposed and spaced for bilaterally encircling the heel of the user, and further comprising in said heel area, a pair of presser arms extending as pincers, each behind the corresponding vamp wall at an upper part thereof, distal with respect to said sole, and located above the heel of the user when the shoe is worn by the user, each presser arm extending in the same direction from a support integral with a rear part of the shoe and being hinged on the support by a respective pin.

2. A sports shoe, according to claim 1, wherein said arms are capable of being pivoted with respect to one another and an actuator is provided, acting between said arms in order to displace them between a position for clamping of said heel area and a position for release of same.

3. A sports shoe, according to claim 2, wherein said actuator is adjustable into at least one intermediate position between said clamping position and said release position.

4. A sports shoe, according to claim 2, wherein said actuator comprises a cam rotatably supported on the shoe and acting on corresponding ends of said arms.

5. A sports shoe, according to claim 2, wherein the arms are hinged to a support in a position such that, with respect to the hinge axis, a control appendage is defined on which said actuator acts.

6. A sports shoe, according to claim 5, wherein said cam is bilateral with symmetrical cam profiles and is mounted on said support between said control appendages.

7. A sports shoe, according to claim 6, wherein said cam profile is of elliptical section.

8. A sports shoe, according to claim 7, wherein said cam is provided on a neck integral with a control knob which is rotatably supported on said support.

9. A sports shoe according to claim 5, wherein the control appendage extending on the opposite side from the corresponding arm with reference to said hinge axis.

10. A sports shoe comprising a sole and a vamp in which is identified a heel area having a rear part from which extend respective walls juxtaposed and spaced for bilaterally encircling the heel of the user, and further comprising in said heel area, a pair of presser arms extending as pincers, each behind the corresponding vamp wall at an upper part thereof, distal with respect to said sole, and located above the heel of the user when the shoe is wore by the user, wherein said arms are capable of being pivoted with respect to one another and an actuator is provided, acting between said arms in order to displace them between a position for clamping of the heel area and a position for release of same, and wherein the arms are hinged to a support in a position such that, with respect to the hinge axis, a control appendage is defined on each arm on which the actuator acts, the control appendage extending on the opposite side from the corresponding arm with reference to said hinge axis.

11. A sports shoe according to claim 10, wherein said actuator is adjustable into at least one intermediate position between said clamping position and said release position.

12. A sports shoe according to claim 11, wherein said actuator comprises a cam rotatably supported on the shoe and acting on corresponding ends of said arms.

13. A sports shoe according to claim 12, wherein said cam is bilateral with symmetrical cam profiles and is mounted on said support between said control appendages.

14. A sports shoe according to claim 13, wherein said cam profile is of elliptical section.

15. A sports shoe according to claim 14, wherein said cam is provided on a neck integral with a control knob which is rotatably supported on said support.

* * * * *